US011101087B2

(12) United States Patent
Terpend

(10) Patent No.: US 11,101,087 B2
(45) Date of Patent: Aug. 24, 2021

(54) CONTROL DEVICE FOR VACUUM BOTTLE CONTACTS OF AN ELECTRICAL SWITCHING DEVICE

(71) Applicant: Schneider Electric Industries SAS, Rueil Malmaison (FR)

(72) Inventor: Serge Terpend, Grenoble (FR)

(73) Assignee: Schneider Electric Industries SAS, Rueil Malmaison (FR)

( * ) Notice: Subject to any disclaimer, the term of this patent is extended or adjusted under 35 U.S.C. 154(b) by 0 days.

(21) Appl. No.: 16/782,303

(22) Filed: Feb. 5, 2020

(65) Prior Publication Data

US 2020/0273645 A1 Aug. 27, 2020

(30) Foreign Application Priority Data

Feb. 21, 2019 (FR) ..... 1901761

(51) Int. Cl.
*H01H 33/42* (2006.01)
*H01H 33/664* (2006.01)

(52) U.S. Cl.
CPC ..... *H01H 33/664* (2013.01); *H01H 33/42* (2013.01); *H01H 2235/01* (2013.01)

(58) Field of Classification Search
CPC .. H01H 33/666; H01H 33/6662; H01H 33/42; H01H 33/66; H01H 2033/6665; H01H 2033/6667; H01H 2033/6668; H01H 2033/426; H01H 2235/01; H01H 3/3015;
(Continued)

(56) References Cited

U.S. PATENT DOCUMENTS 5,436,414 A * 7/1995 Hodkin ..... H01H 33/666 200/17 R
6,472,627 B1 * 10/2002 Yoon ..... H01H 3/30 200/400

(Continued)

FOREIGN PATENT DOCUMENTS

FR 1035059 8/1953
FR 2921196 3/2009

OTHER PUBLICATIONS

Search Report and Written Opinion for French Patent Application No. FR1901761, dated Nov. 21, 2019, 6 pages.

(Continued)

*Primary Examiner* — William A Bolton
(74) *Attorney, Agent, or Firm* — Locke Lord LLP

(57) ABSTRACT

A control device for a movable contact relative to a fixed contact of a vacuum bottle of an electrical switching device. The control device includes a principal mechanism for disconnection and connection of the contacts, of the mechanical energy accumulation type. The control device further includes an auxiliary disconnection-assistance mechanism arranged such as to accumulate mechanical energy when the movable contact is moved towards the connection position and such as to restore the mechanical energy thus accumulated in such a manner as to exert an additional disconnection force in the form of an impact tending to move the movable contact from the connection position towards the disconnection position when the movable contact is immobilized in the connection position despite the action of the principal disconnection force.

12 Claims, 7 Drawing Sheets

(58) Field of Classification Search
CPC .... H01H 3/3031; H01H 3/3042; H01H 3/001; H01H 71/501
USPC ..... 218/140, 120, 123, 153, 154; 200/400, 200/337, 443
See application file for complete search history.

(56) References Cited

U.S. PATENT DOCUMENTS

| | | | | |
|---|---|---|---|---|
| 6,917,006 | B2 * | 7/2005 | Bachofen | H01H 3/3052 200/318.2 |
| 8,378,242 | B2 * | 2/2013 | Kim | H01H 33/666 200/288 |
| 9,704,661 | B2 * | 7/2017 | Chen | H01H 3/26 |
| 10,012,697 | B2 * | 7/2018 | Yang | G01R 31/3277 |
| 2008/0036561 | A1 | 2/2008 | Hartinger et al. | |
| 2010/0078300 | A1 * | 4/2010 | Freundt | H01H 3/30 200/337 |

OTHER PUBLICATIONS

English Machine Translation of French Patent Application Publication No. FR2921196 dated Mar. 20, 2009, 12 pages.
English Machine Translation of French Patent Application Publication No. FR1035059 dated Aug. 14, 1953, 4 pages.

* cited by examiner

CONTROL DEVICE FOR VACUUM BOTTLE CONTACTS OF AN ELECTRICAL SWITCHING DEVICE

TECHNICAL FIELD

The invention relates to the field of electrical switching devices, in particular devices for switching electric current in a vacuum. The invention pertains notably to high-voltage circuit-breaker-type devices. However, it is not restricted to this type of device and may also relate to devices such as contactors or switches. Furthermore, the invention has applications in different voltage fields, notably medium voltage or high voltage, i.e. a device operating at a voltage in excess of 1000 V. In the present document, the expression "electrical switching device" covers, without distinction, a plurality of types of electrical devices, such as a switch, a circuit breaker, a contactor, a fused switch, a recloser, etc.

More specifically, the invention relates to a control device for vacuum bottle contacts of such an electrical switching device.

PRIOR ART

Control devices for a movable contact of a vacuum bottle, making it possible to separate the movable contact from a corresponding fixed contact by means of an energy-accumulation disconnection mechanism are known in the prior art.

FIGS. 1 and 2 show a conventional control device. The disconnection mechanism of this device comprises a disconnection spring 3 and a contact pressure spring 14 calibrated to distance the movable contact 91 from the fixed contact 92 after receiving a disconnection command, according to the sequence illustrated in FIGS. 1 and 2. FIG. 1 shows the movable contact 91 in the disconnection position whilst FIG. 2 shows the movable contact 91 in the connection position.

Upon connection, under load, of the contacts 91 and 92, these latter may become welded to one another under certain extreme current and/or voltage conditions, such that the energy accumulated by the disconnection spring 3 and by the contact pressure spring 14 may prove to be insufficient to separate them from one another.

An object of the invention is to allow the disconnection of such contacts when they are welded to one another and the energy accumulated in the springs is insufficient to break the weld between them.

PRESENTATION OF THE INVENTION

To that end, a subject of the invention is a control device for a movable contact relative to a fixed contact of at least one vacuum bottle for an electrical switching device, between a connection position in which the movable contact bears against the fixed contact and a disconnection position in which the movable contact is at a distance from the fixed contact. This device comprises a principal disconnection and connection mechanism arranged such as:

- to move the movable contact towards the connection position when the device receives a connection command and to accumulate mechanical energy when the movable contact is moved towards the connection position,
- to restore the mechanical energy thus accumulated in such a manner as to exert a principal disconnection force tending to move the movable contact from the connection position towards the disconnection position when the device receives a disconnection command.

According to the invention, this device it comprises an auxiliary disconnection-assistance mechanism arranged such as:

- to accumulate mechanical energy when the movable contact is moved towards the connection position,
- to restore the mechanical energy thus accumulated in such a manner as to exert an additional disconnection force tending to move the movable contact from the connection position towards the disconnection position when the movable contact is immobilized in the connection position despite the action of the principal disconnection force, in other words when this principal disconnection force is insufficient to move the movable contact from the connection position towards the disconnection position.

The auxiliary mechanism thus constitutes a second energy-accumulation mechanism promoting breaking of the weld between the contacts when the mechanical energy accumulated by the principal disconnection mechanism is insufficient to separate the contacts from one another.

In one embodiment, said principal mechanism may comprise an entrainment member to which the movable contact is connected, a disconnection spring, preferably a compression spring, capable of accumulating and restoring said intrinsic mechanical energy to the principal mechanism, the disconnection spring being arranged to exert said principal disconnection force on the entrainment member in such a manner as to move the movable contact towards the disconnection position when the device receives said disconnection command, it being possible for the principal mechanism to further comprise a control shaft and a principal transmission system connecting the control shaft to the entrainment member. According to this embodiment this device may be configured such as:

- to liberate the rotation of the control shaft when the device receives said disconnection command,
- to entrain the control shaft in rotation in a connection direction when the device receives said connection command, such a rotation of the control shaft moving the movable contact towards the connection position by means of the entrainment member such that the disconnection spring accumulates said mechanical energy,
- to immobilize the rotation of the control shaft when the movable contact is in the connection position.

Preferably, the entrainment member may comprise a pole shaft, the entrainment member forming a first lever integral in rotation with the pole shaft and the control shaft may be provided with a second lever integral in rotation with the control shaft, said principal transmission system comprising a connection connecting rod connected to the first and to the second lever.

In one embodiment, the auxiliary disconnection-assistance mechanism comprises an auxiliary disconnection spring, preferably a tension spring, this auxiliary disconnection spring being capable of accumulating and restoring said intrinsic mechanical energy to the auxiliary mechanism. According to this embodiment, this auxiliary mechanism may further comprise a strike arm that can move in rotation about a fixed shaft, the auxiliary disconnection spring being arranged such as to exert said additional disconnection force on the strike arm in such a manner as to entrain it in rotation about said fixed shaft when the device receives said disconnection command, the strike arm being arranged such as to transmit the additional disconnection force to said entrainment member in the form of an impact when the movable contact is immobilized in the connection position despite the action of the principal disconnection force.

Such an auxiliary mechanism is relatively simple to implement and, through the action of the movement of the strike arm, makes it possible to exert an additional disconnection force, in this case a strike, of such a nature as to break the weld between the contacts.

Moreover, the distance between the fixed shaft and that part of the strike arm that performs the strike as such, i.e. transmitting the additional disconnection force to the entrainment member, constitutes a lever arm that makes it possible to use an auxiliary disconnection spring of relatively low stiffness, notably relative to the stiffness of the principal disconnection spring.

This makes it possible to uncouple the auxiliary mechanism from the principal mechanism when the principal disconnection force is sufficient to open the contacts, i.e. in this case to prevent transmission of the additional disconnection force to the entrainment member.

In one embodiment, the auxiliary mechanism may comprise an auxiliary transmission system, this auxiliary transmission system comprising a release connecting rod connecting the connection connecting rod to the second lever and also a disconnection connecting rod connecting the strike arm to the second lever in such a manner as to link the control shaft and the strike arm in rotation. According to this embodiment the auxiliary mechanism is preferably arranged such that, when the device receives the disconnection command and the movable contact is immobilized in the connection position despite the action of the principal disconnection force:

- the connection and release connecting rods are moved in rotation relative to one another through the action of the auxiliary disconnection spring, reducing the distance between an end of the connection connecting rod connected to the first lever and an end of the release connecting rod connected to the second lever,
- the strike arm is entrained in rotation about said fixed shaft through the action of the auxiliary disconnection spring until one of the ends thereof strikes the first lever or a component connected thereto, this strike transmitting said additional disconnection force to the entrainment member.

In one embodiment, the auxiliary mechanism may comprise a torsion spring arranged such as to orient the direction of rotation of the release connecting rod relative to the connection connecting rod.

Preferably, the fixed shaft of the strike arm may be parallel to the axes of rotation of the pole shaft and of the control shaft.

Such an arrangement typically makes it possible to reduce the compactness of the device and to simplify its functioning.

The invention also relates to an electrical switching device comprising one or more vacuum bottles, each comprising a movable contact and a fixed contact, this device comprising a device as defined above.

This electrical switching device may consist of a high-voltage circuit breaker.

Further advantages and features of the invention will become apparent on reading the following non-limiting detailed description.

BRIEF DESCRIPTION OF THE DRAWINGS

The following detailed description makes reference to the appended drawings, in which.

DETAILED DESCRIPTION OF EMBODIMENTS

Figure 1:
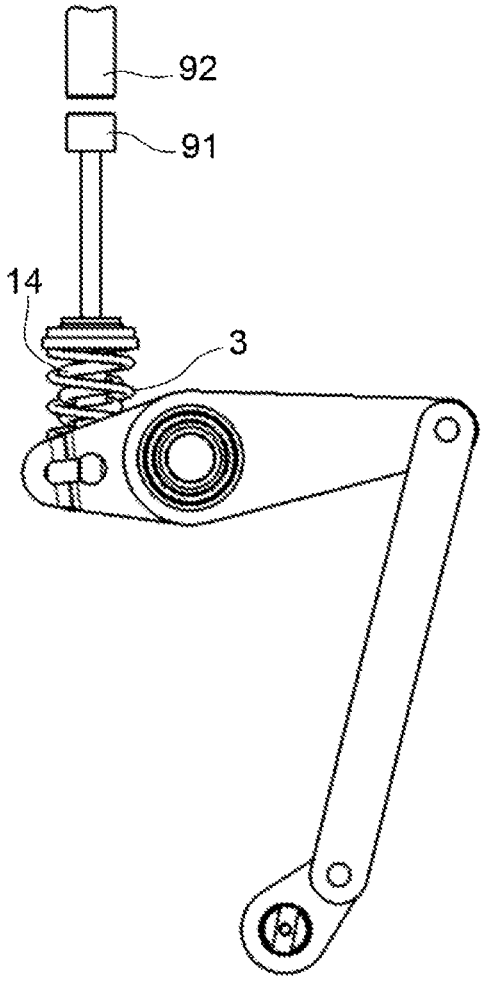
FIG. 1 Prior Art
FIG. 1 is a schematic view of a control device for a movable contact of a vacuum bottle of a prior art electrical switching device, in a disconnection position of the movable contact.
Figure 2:
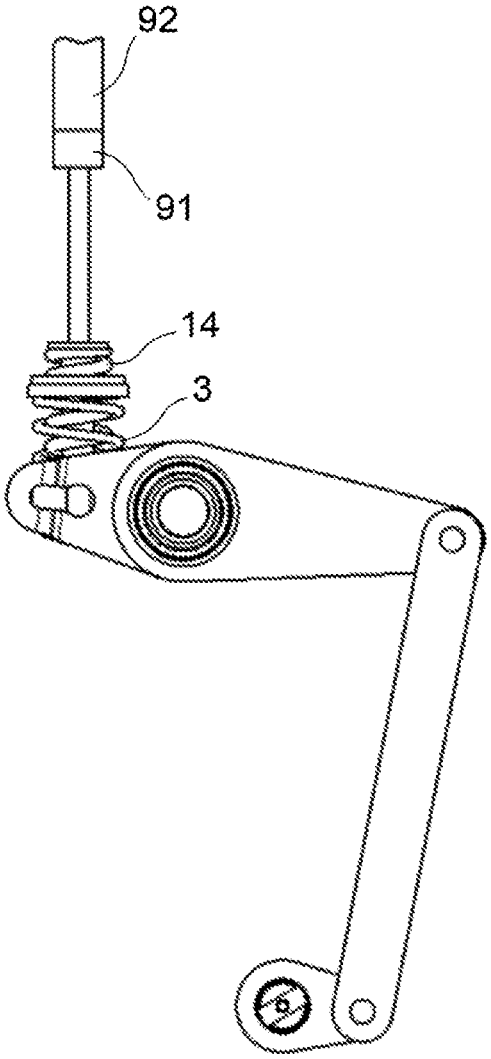
FIG. 2 Prior Art
FIG. 2 is a schematic view of the control device of FIG. 1, in a connection position of the movable contact.
Figure 3:
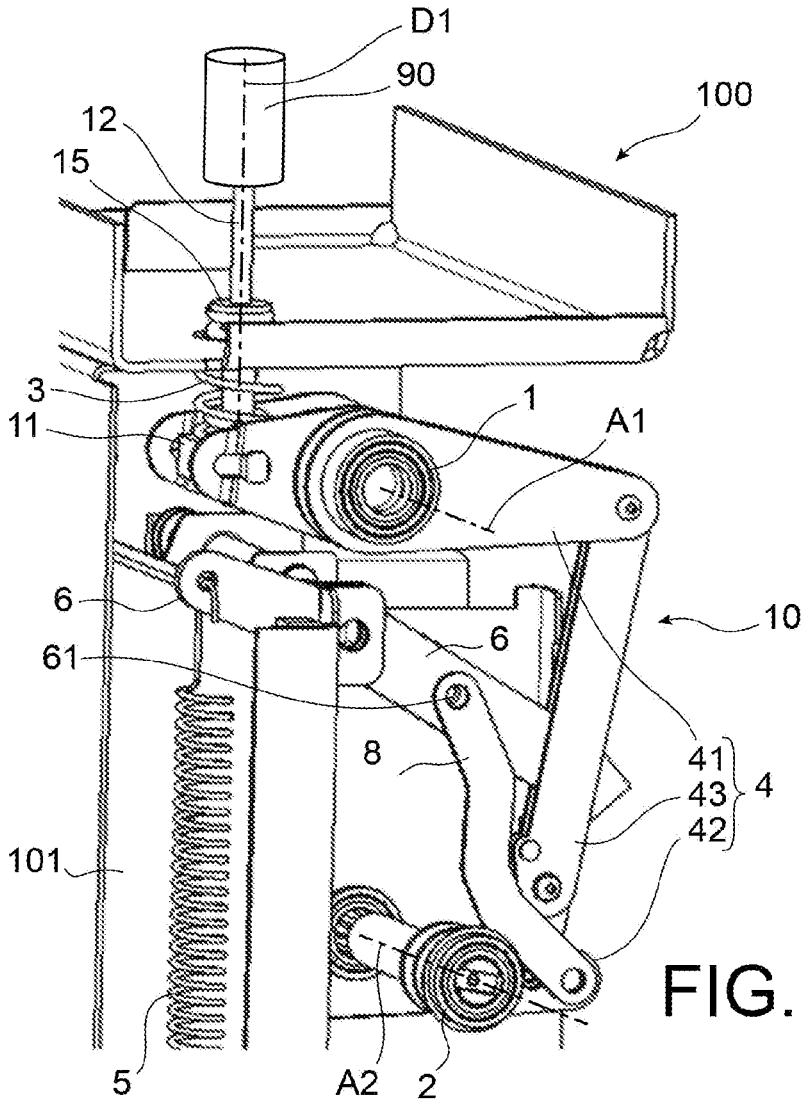
FIG. 3 is a partial schematic view in perspective of an electrical switching device according to the invention, showing a control device for a movable contact of a vacuum bottle of this device.

FIG. 3 shows a part of an electrical switching device 100, of high-voltage circuit breaker type, equipped with a vacuum bottle 90. This device 100 may typically comprise a plurality of vacuum bottles (configuration with a plurality of bottles not shown).

The invention relates more specifically to a control device 10 for a movable contact 91 of the vacuum bottle 90 relative to a fixed contact of this bottle 90. As may be inferred from the following description, this control device 10 is capable of simultaneously commanding the disconnection of a plurality of movable contacts 91 when the device 100 is equipped with a plurality of vacuum bottles 90.

Figure 4:
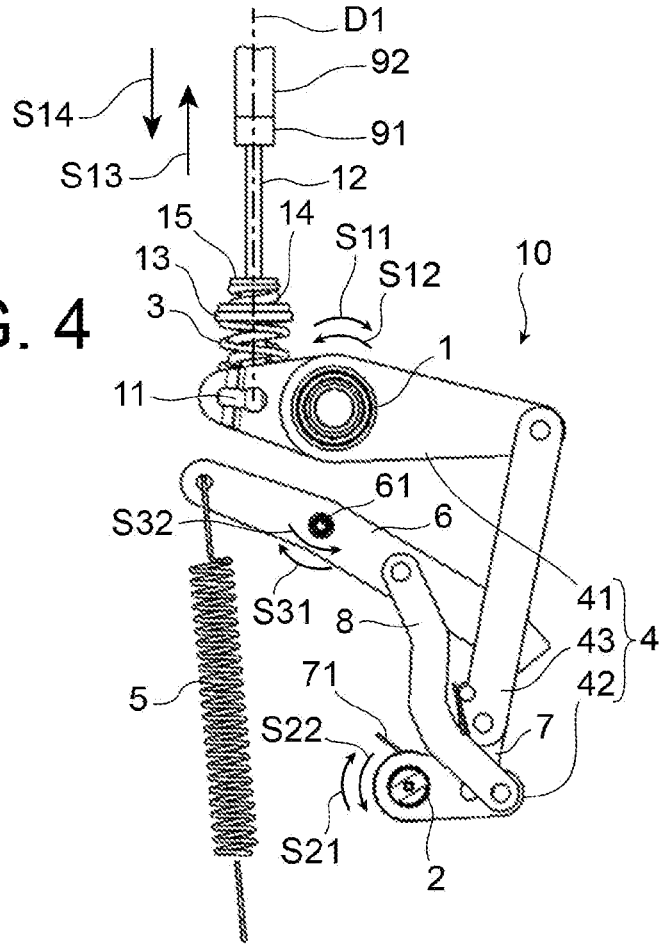
FIG. 4 is a schematic view of the control device of the device of FIG. 3, in a connection position of the movable contact.

With reference to FIGS. 3 and 4, the control device 10 comprises a pole shaft 1 that can move in rotation about an axis A1 relative to a support element 101 of the device 100.

The pole shaft 1 carries, for each vacuum bottle 90, a bearing 11 connected to the movable contact 91 of this bottle 90 by means of a rod 12, one of the ends of which is fixed to the bearing 11 and the other end of which is fixed to the movable contact 91.

This device 10 makes it possible in a translational manner along a direction D1 to move the rod 12 and the movable contact 91 relative to the corresponding fixed contact 92 when the pole shaft 1 is moved in rotation about the axis A1. In particular, when the pole shaft 1 is moved in rotation about the axis A1 in a first direction S11 of rotation, the movable contact 91 is moved along the direction D1 in a first direction S13 of translation corresponding to a direction of connection of the contacts 91 and 92 (see FIG. 4). When the pole shaft 1 is moved in rotation about the axis A1 in a second direction S12 of rotation, the movable contact 91 is moved along the direction D1 in a second direction S14 of translation corresponding to a direction of disconnection of the contacts 91 and 92.

Thus, when the device 100 comprise a plurality of bottles 90 (configuration not shown), the rotation of the pole shaft 1 makes it possible to disconnect or to connect the contacts 91 and 92 of each of the bottles 90 simultaneously.

Principal Disconnection and Connection Mechanism

The control device 10 comprises, for each vacuum bottle 90, a disconnection spring 3 that, in this example, works in compression. The spring 3 extends around the rod 12 and bears, on the one hand, against a bearing surface of the bearing 11 (visible in FIG. 3) and, on the other hand, against a facing surface of a corresponding bearing element 13 (visible in FIG. 4). This bearing element 13 is fixed relative to the fixed contact 92 of the corresponding bottle 90 and relative to the support element 101 of the device 100.

With a view to maintaining a pressure between the contacts 91 and 92, for each vacuum bottle 90 the device 10 comprises a contact pressure spring 14 that, in this example, works in compression. The spring 14 also extends around the rod 12 and bears, on the one hand, against said bearing surface of the bearing 11 and, on the other hand, against a facing surface of a corresponding bearing element 15 (visible in FIG. 4). This bearing element 15 is integral with the rod 12 in translation in the direction D1.

The pole shaft 1 is provided with a first lever 41, integral with the pole shaft 1 in rotation about the axis A1, such that the rotation of one of these elements about the axis A1 entrains the other of these elements in rotation about the axis A1 in a common direction (S11 or S12) of rotation. The first lever 41 forms an entrainment member for the pole shaft 1.

The control device 10 further comprises a control shaft 2 capable of being entrained, by a control mechanism (not shown), in rotation about an axis A2 of rotation parallel to the axis A1 of rotation of the pole shaft 1.

The control shaft 2 is provided with a second lever 42 integral with the control shaft 2 in rotation about the axis A2, such that the rotation of one of these elements about the axis A2 entrains the other of these elements in rotation about the axis A2 in a common direction (S21 or S22, see below) of rotation.

The first lever 41 and the second lever 42 are connected to one another by a double connecting rod formed by a connection connecting rod 43 and a so-called "release" connecting rod 7, which will be described in greater detail below, in the part pertaining to the auxiliary mechanism. The connection connecting rod 43 is articulated at one of the ends thereof to the first lever 41 and at the other end thereof to the release connecting rod 7. The release connecting rod 7 is articulated at one of the ends thereof to the connection connecting rod 43 and at the other end thereof to the second lever 42.

This double connecting rod and also the second lever 42 form a principal transmission system connecting the control shaft 2 to the entrainment member 41 for the pole shaft 1.

The various components of the device 10 just described form a principal disconnection and connection mechanism that makes it possible to move the movable contact 91 between a connection position, in which it bears against the fixed contact 92, and a disconnection position in which it is at a distance from the fixed contact 92.

Figure 5:
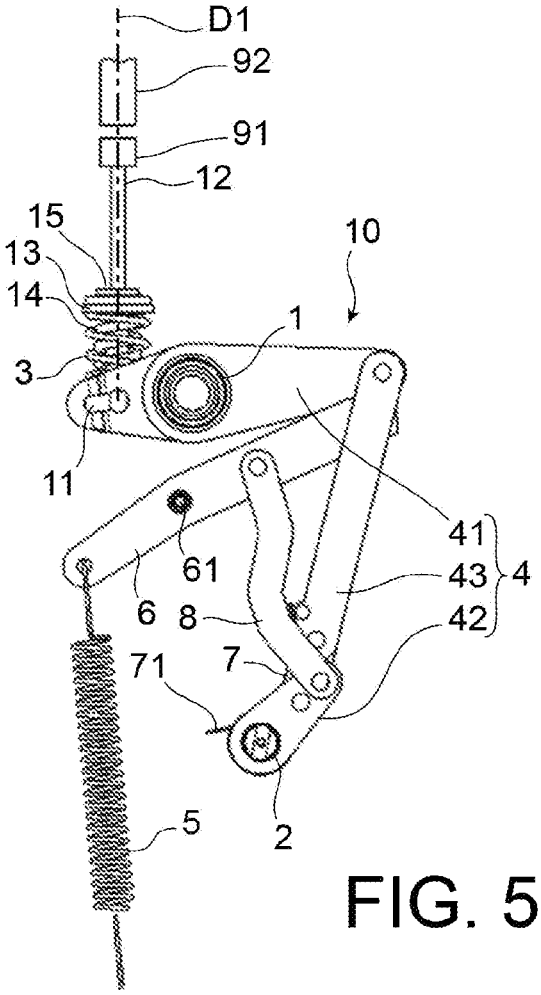
FIG. 5 is a schematic view of the control device of the device of FIG. 3, in a disconnection position of the movable contact.

The connection position is shown in FIG. 4 and the disconnection position is shown in FIG. 5.

In the connection position, the disconnection spring 3 and the contact pressure spring 14 are compressed and thus store mechanical energy exerting a principal disconnection force against the bearing surface of the bearing 11, this force tending to entrain the pole shaft 1 and the first lever 41 in rotation about the axis A1 in said second direction S12 of rotation (see FIG. 4). Whilst the device 10 does not receive a disconnection command, the rotation of the control shaft 2 is immobilized such that the movable contact 91 is maintained in the connection position through the action of the disconnection spring 3 and of the contact pressure spring 14 and of the connecting rods 43 and 7 that prevent the first lever 41 and the pole shaft 1 from turning in said second direction S12 of rotation. Indeed, in this position, the connecting rods 43 and 7 are aligned such that the distance between, on the one hand, the articulation of the connecting rod 43 with the first lever 41 and, on the other hand, the articulation of the connecting rod 7 with the second lever 42 cannot be increased.

Disconnection by the Principal Mechanism

In order to pass from the connection position (FIG. 4) to the disconnection position (FIG. 5), the device 10 is configured such as to liberate the rotation of the control shaft 2 when a disconnection command is issued.

This disconnection command thus enables said principal disconnection force exerted by the disconnection spring 3 and by the contact pressure spring 14 to entrain the pole shaft 1 and the first lever 41 in rotation bout the axis A1 in a second direction S12 of rotation. This rotation entrains the movable contact 91 in translation in the disconnection direction S14. This rotation simultaneously entrains the second lever 42 and the control shaft 2 in rotation in a disconnection direction S22, by means of the connecting rods 43 and 7.

Naturally, the contact pressure spring 14 is dimensioned such that the free length thereof is such that, in the disconnection position, the movable contact 91 is at a distance from the fixed contact 92 (see FIG. 5).

Connection by the Principal Mechanism

In order to pass from the disconnection position (FIG. 5) to the connection position (FIG. 4), the device 10 is configured such as to entrain the control shaft 2 in rotation in a connection direction S21 when a connection command is emitted.

Such a rotation of the control shaft 2 entrains the first lever 41 and the pole shaft 1 in rotation in the first direction S11 of rotation by means of the connecting rods 43 and 7 and of the second lever 42, which moves the movable contact 91 in translation in the disconnection direction S13.

Upon such a connection of the contacts 91 and 92 and also upon disconnection by the principal mechanism (without assistance from the auxiliary mechanism; see below), the double connecting rod formed by the connecting rods 43 and 7 acts like a single connecting rod.

Upon connection of the contacts 91 and 92, i.e. upon rotation of the pole shaft 1 between the configuration of FIG. 5 and that of FIG. 4, the disconnection spring 3 accumulates mechanical energy.

Principle of Energy Accumulation by the Principal Mechanism

Variants of the disconnection and connection principal mechanism may differ from the particular embodiment just described. For example, in an embodiment that is not shown, the disconnection spring may be a tension spring.

More generally, the principal mechanism is arranged in such a manner as to move the movable contact 91 towards the connection position when a connection command is emitted and to accumulate mechanical energy when it is moved towards the connection position. This principal mechanism is further arranged such as to restore the mechanical energy thus accumulated in such a manner as to exert a principal disconnection force tending to move the movable contact 91 from the connection position towards the disconnection position when the device 10 receives a disconnection command.

Auxiliary Disconnection-Assistance Mechanism

According to the invention, the device 10 comprises an auxiliary disconnection-assistance mechanism provided to break the weld between the contacts 91 and 92 when the principal mechanism alone does not make it possible to break the weld between them.

With reference to FIGS. 3 and 4, the auxiliary mechanism comprises a strike arm 6 that can move in rotation about a fixed shaft 61.

This fixed shaft 61 is parallel to the axes A1 and A2 of rotation of the pole shaft 1 and of the control shaft 2, respectively.

The auxiliary mechanism comprises a disconnection connecting rod 8 connecting the strike arm 6 to the second lever 42 in such a manner as to link the control shaft 2 in rotation with the strike arm 6. To that end, the disconnection connecting rod 8 is articulated at one of the ends thereof to the strike arm 6, at a point of the arm 6 located between the fixed shaft 61 and a strike end of this arm 6; the disconnection connecting rod 8 is articulated at the other of the ends thereof to the second lever 42. Thus, the rotation of the second lever 42 in the disconnection direction S22 entrains the strike arm 6 in rotation in a strike direction S32, and, reciprocally, the rotation of the second lever 42 in the connection direction S21 entrains the strike arm 6 in rotation in an arming direction S31, and reciprocally (see FIG. 4).

In this example, the auxiliary mechanism comprises an auxiliary-disconnection tension spring 5. This spring 5 is connected on the one hand to a fixed part of the device 10, i.e. fixed relative to the support element 101 of the device 100, and, on the other hand, at an end of the strike arm 6 that is opposite, relative to the fixed shaft 61, to its strike end.

In the connection position shown in FIG. 4, the auxiliary disconnection spring 5 is extended and thus stores mechanical energy exerting a force on the strike arm 6 tending to entrain the latter in rotation about the fixed shaft 61 in the strike direction S32. As long as the device 10 does not receive the disconnection command, the rotation of the control shaft 2 is immobilized such that the strike arm 6 is unable to turn in the strike direction S32, given the presence of the disconnection connecting rod 8.

The disconnection connecting rod 8 and also the release connecting rod 7 form an auxiliary transmission system arranged such as to entrain a strike by the arm 6 on the entrainment member 41 when the movable contact 91 is immobilized in the connecting position, despite the liberation of the rotation of the control shaft 2, i.e. when the principal disconnection force is insufficient to open or to break the weld between the contacts 91 and 92.

Disconnection Assistance by the Auxiliary Mechanism

When the contacts 91 and 92 are welded to one another, the principal mechanism may prove to be insufficient to open the contacts 91 and 92. In this case, the movable contact 91 is immobilized in the connection position illustrated in FIG. 4 despite the ability of the control shaft 2 to turn about the axis A2 through the action of the disconnection spring 3 and of the contact pressure spring 14 (see above).

The result of this is that the first lever 41 is able to turn about the axis A1 in the second direction S12 of rotation only by an angle corresponding to the compression of the contact pressure spring 14, owing to the weld between the contacts 91 and 92 that opposes the action of the disconnection spring 3.

However, the action of the auxiliary disconnection spring 5 on the strike arm 6 tends to entrain the second lever 42 in rotation about the axis A2 in the disconnection direction S22, by means of the disconnection connecting rod 8.

Given the presence of the release connecting rod 7, the second lever 42 and the strike arm 6 may each enter into rotation, respectively, about the axis A2 in the disconnection direction S22 and about the fixed shaft 61 in the strike direction S32. In effect, the release connecting rod 7 and the connection connecting rod 43 are able to pivot relative to one another through the action of the auxiliary disconnection spring 5 and thereby to reduce the distance between, on the one hand, the articulation of the connecting rod 43 and the first lever 41 and, on the other hand, the articulation of the connecting rod 7 and the second lever 42, according to the configuration illustrated in FIG. 6. The release connecting rod 7 thus makes it possible to release the auxiliary mechanism so that it contributes, by means of the strike it performs, to disconnection of the contacts 91 and 92.

With a view to orienting the direction of rotation of the release connecting rod 7 relative to the connection connecting rod 43, a torsion spring 71 may be mounted between these connecting rods 7 and 43. This orientation function may be provided by any other means, for example with the aid of a ratchet mounted on one of these connecting rods in such a manner as to prevent their relative rotation in a direction incompatible with the functioning of the device 10 (not shown).

Figure 6:
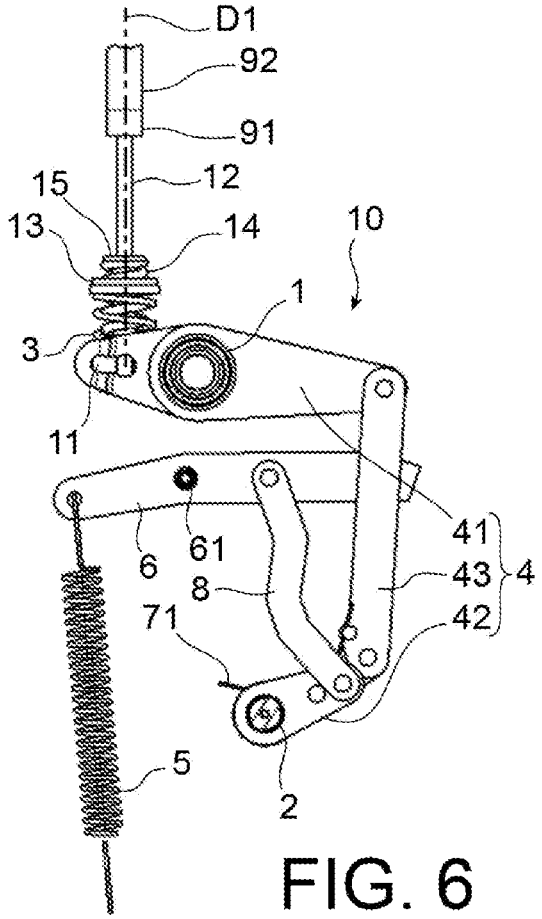
FIG. 6 is a schematic view of the control device of the device of FIG. 3, in an intermediate position in which an auxiliary mechanism of the device is functioning.

In the configuration of FIG. 6, the strike arm 6 is then entrained in rotation about the fixed shaft 61 in the strike direction S32 through the action of the auxiliary disconnection spring 5, this rotation entraining the second lever 42 and the control shaft 2 in rotation about the axis A2 in the disconnection direction S22.

Figure 7:
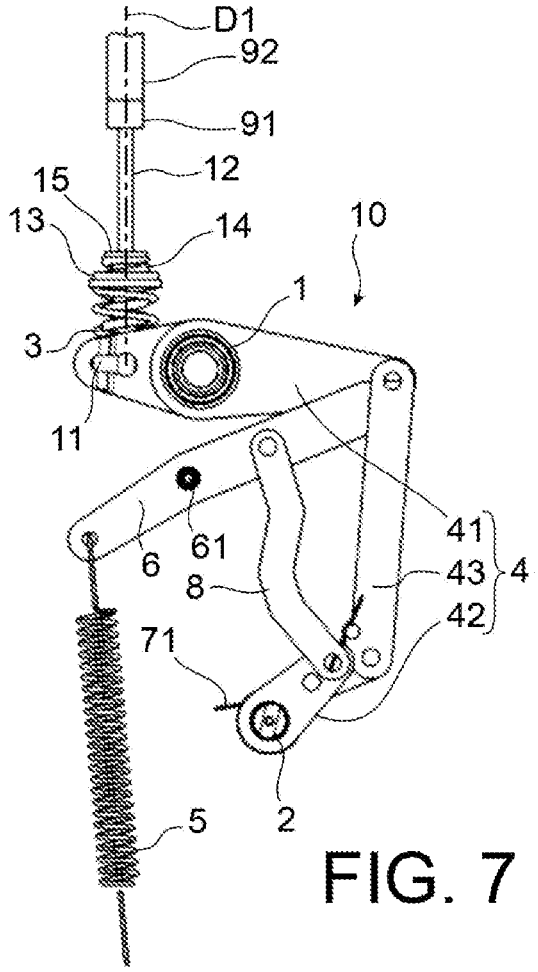
FIG. 7 is a schematic view of the control device for the device of FIG. 3, in a strike position for freeing the movable contact.
Figure 8:
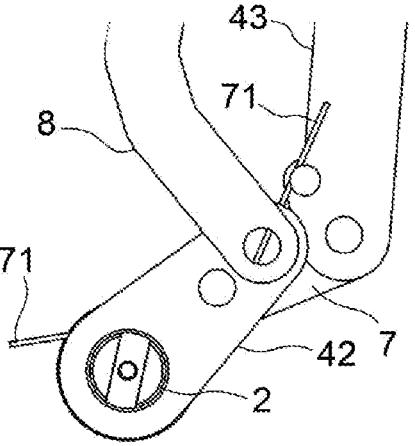
FIG. 8 is an enlargement of the control device for the device of FIG. 3, in the position of FIG. 7, centred on a release system for a strike mechanism of this device.

The strike arm 6 continues its rotation until its strike end strikes the first lever 41 or a component connected thereto (see FIG. 7). Such a strike makes it possible to transmit an additional disconnection force to the first lever 41 in the form of an impact, which is capable of breaking the weld between the contacts 91 and 92.

When the weld between the contacts 91 and 92 is broken through the effect of this strike, the pole shaft 1 and the first lever 41 are then entrained in rotation about the axis A1 in the second direction S12 of rotation, through the action of the disconnection spring 3, entraining the movable contact 91 in translation in the disconnection direction S14. The device 10 thus passes from the configuration of FIG. 7 to the configuration of FIG. 5.

Naturally, when the principal mechanism makes it possible to open the contacts 91 and 92 without requiring assistance from the auxiliary mechanism, the passage from the connection position (FIG. 4) to the disconnection position (FIG. 5) nevertheless is reflected in a rotation of the strike arm 6 about the fixed shaft 61 in the strike direction S32 since, as the control shaft 2 is able to enter into rotation as a result of the disconnection command, the auxiliary disconnection spring 5 restores the mechanical energy it has accumulated upon connection. The strike arm 6 does not, however, become involved in this case with the entrainment member 41, given the geometry and the arrangement of the various components of the device 10.

Principle of Energy Accumulation by the Auxiliary Mechanism

Upon closure of the contacts 91 and 92, i.e. upon rotation of the pole shaft 1 from the configuration of FIG. 5 to the configuration of FIG. 4, the auxiliary disconnection spring 5 accumulates mechanical energy.

Variants of the auxiliary disconnection-assistance mechanism may, naturally, differ from the particular embodiment just described. For example, in an embodiment that is not shown, the auxiliary disconnection spring may be a compression spring.

More generally, the auxiliary mechanism is arranged in such a manner as to accumulate mechanical energy when the movable contact 91 is moved towards the connection position and to restore the mechanism energy thus accumulated in such a manner as to exert an additional disconnection force tending to move the movable contact 91 from the connection position towards the disconnection position when the movable contact 91 is immobilized in the connection position despite the action of the principal disconnection force.

The invention claimed is:

1. A control device for a movable contact relative to a fixed contact of at least one vacuum bottle for an electrical switching device, between a connection position in which the movable contact bears against the fixed contact and a disconnection position in which the movable contact is at a distance from the fixed contact, the control device comprising a principal disconnection and connection mechanism arranged such as:

to move the movable contact towards the connection position when the control device receives a connection command and to accumulate mechanical energy when the movable contact is moved towards the connection position, to restore the mechanical energy thus accumulated in such a manner as to exert a principal disconnection force tending to move the movable contact from the connection position towards the disconnection position when the device receives a disconnection command, wherein the control device comprises an auxiliary disconnection-assistance mechanism arranged such as:

to accumulate mechanical energy when the movable contact is moved towards the connection position, to restore the mechanical energy thus accumulated in such a manner as to exert an additional disconnection force tending to move the movable contact from the connection position towards the disconnection position when the movable contact is immobilized in the connection position despite an action of the principal disconnection force.

2. The control device according to claim 1, wherein said principal mechanism comprises an entrainment member to which the movable contact is connected, a disconnection spring capable of accumulating and restoring intrinsic mechanical energy to the principal mechanism, the disconnection spring being arranged to exert said principal disconnection force on the entrainment member in such a manner as to move the movable contact towards the disconnection position when the control device receives said disconnection command, the principal mechanism further comprising a control shaft and a principal transmission system connecting the control shaft to the entrainment member, the control device being configured such as:

to liberate rotation of the control shaft when the control device receives said disconnection command, to entrain the control shaft in rotation in a connection direction when the control device receives said connection command, the rotation of the control shaft moving the movable contact towards the connection position by means of the entrainment member such that the disconnection spring accumulates said mechanical energy, to immobilize the rotation of the control shaft when the movable contact is in the connection position.

3. The control device according to claim 2, wherein the entrainment member comprises a pole shaft, the entrainment member forming a first lever integral in rotation with the pole shaft, and wherein the control shaft is provided with a second lever integral in rotation with the control shaft, said principal transmission system comprising a connection connecting rod connected to the first and to the second lever.

4. The control device according to claim 3, wherein the auxiliary disconnection-assistance mechanism comprises an auxiliary disconnection spring, the auxiliary disconnection spring being capable of accumulating and restoring said intrinsic mechanical energy to the auxiliary mechanism, the auxiliary mechanism further comprising a strike arm that can move in rotation about a fixed shaft, the auxiliary disconnection spring being arranged such as to exert said additional disconnection force on the strike arm in such a manner as to entrain it in rotation about said fixed shaft when the control device receives said disconnection command, the strike arm being arranged such as to transmit the additional disconnection force to said entrainment member in a form of an impact when the movable contact is immobilized in the connection position despite the action of the principal disconnection force, and wherein the auxiliary mechanism further comprises an auxiliary transmission system, the auxiliary transmission system comprising a release connecting rod connecting the connection connecting rod to the second lever and also a disconnection connecting rod connecting the strike arm to the second lever in such a manner as to link the control shaft and the strike arm in rotation, said auxiliary mechanism being arranged such that, when the control device receives the disconnection command and the movable contact is immobilized in the connection position despite the action of the principal disconnection force:

the connection and release connecting rods are moved in rotation relative to one another through an action of the auxiliary disconnection spring, reducing a distance between an end of the connection connecting rod connected to the first lever and an end of the release connecting rod connected to the second lever, the strike arm is entrained in rotation about said fixed shaft through the action of the auxiliary disconnection spring until one of the ends thereof strikes the first lever or a component connected thereto, the strike transmitting said additional disconnection force to the entrainment member.

5. The control device according to claim 4, wherein the auxiliary mechanism comprises a torsion spring arranged such as to orient a rotation direction of the release connecting rod relative to the connection connecting rod.

6. The control device according to claim 4, wherein the auxiliary disconnection spring is a tension spring.

7. The control device according to claim 2, wherein the auxiliary disconnection-assistance mechanism comprises an auxiliary disconnection spring, the auxiliary disconnection spring being capable of accumulating and restoring intrinsic mechanical energy to the auxiliary mechanism, the auxiliary mechanism further comprising a strike arm that can move in rotation about a fixed shaft, the auxiliary disconnection spring being arranged such as to exert said additional disconnection force on the strike arm in such a manner as to entrain it in rotation about said fixed shaft when the control device receives said disconnection command, the strike arm being arranged such as to transmit the additional disconnection force to said entrainment member in a form of an impact when the movable contact is immobilized in the connection position despite the action of the principal disconnection force.

8. The control device according to claim 7, wherein the fixed shaft of the strike arm is parallel to axes of rotation of the pole shaft and of the control shaft.

9. The control device according to claim 7, wherein the auxiliary disconnection spring is a tension spring.

10. The control device according to claim 2, wherein the disconnection spring is a compression spring.

11. An electrical switching device comprising one or more vacuum bottles, each comprising a movable contact and a fixed contact, the electrical switching device further comprising the control device according to claim 1.

12. The electrical switching device according to claim 11, further comprising a high-voltage circuit breaker.

* * * * *